United States Patent [19]

Fuzek

[11] 4,104,439

[45] Aug. 1, 1978

[54] TEXTILE FIBER

[75] Inventor: John Frank Fuzek, Kingsport, Tenn.

[73] Assignee: Eastman Kodak Company, Rochester, N.Y.

[21] Appl. No.: 802,089

[22] Filed: May 31, 1977

[51] Int. Cl.[2] ..... D02G 3/00

[52] U.S. Cl. ..... 428/397; 428/364; 428/374; 260/860

[58] Field of Search ..... 428/374, 364, 397; 260/860; 264/103

[56] References Cited

U.S. PATENT DOCUMENTS

| | | | |
|---|---|---|---|
| 3,381,058 | 4/1968 | Caldwell et al. | 268/860 |
| 3,425,893 | 2/1969 | Sims | 428/397 |
| 3,557,039 | 1/1971 | McIntyre et al. | 260/860 |
| 3,589,956 | 6/1971 | Kranz et al. | 428/397 |
| 3,639,195 | 2/1972 | Sanders | 428/397 |
| 3,700,544 | 10/1972 | Matsui | 428/397 |
| 3,705,225 | 12/1972 | Taylor | 264/103 |

*Primary Examiner*—George F. Lesmes
*Assistant Examiner*—E. Rollins Buffalow
*Attorney, Agent, or Firm*—William P. Heath, Jr.; Daniel B. Reece

[57] ABSTRACT

Silk-like fibers comprising poly(1,4-cyclohexylenedimethylene terephthalate), and modified poly(1,4-cyclohexylenedimethylene terephthalate), the fibers having a non-round cross section, having a denier per filament of about 1.5 and containing microfibrils of a polyester other than poly(cyclohexylenedimethylene terephthalate).

4 Claims, No Drawings

TEXTILE FIBER

This invention relates to polyester fiber having silk-like aesthetics. More particularly the invention relates to particular polyester fibers having silk-like aesthetics.

Historically, silk has been one of the most wanted fibers due to its aesthetics and crisp hand. Silk is obtained by stripping the fiber from the cocoons of the larvae of the Bombyx Mori. The processing and availability of the silk fiber results in the price of fabrics made of silk to be very high as compared to fabrics made of synthetic fibers.

With the advent of man-made fibers, there has been a continuing effort to simulate silk. When rayon was first produced commercially, it was sold as artificial silk. In producing these man-made fibers, the ability to design properties to suit different end uses has become available. Many attempts have been partially successful in approaching the properties of silk, but prior to the present invention, no one has succeeded in matching the warm deep luster, the liveliness and the attractive luxurious hand of natural silk.

In U.S. Pat. No. 3,705,225 a fiber reported to have silk-like appearance is disclosed. Here the inventor adds a surface modifying agent to polyester yarn prepared by melt spinning through non-round spinneret orifices, the modifying agent being present to produce a rough-surfaced yarn. The polyester preferred is poly(ethylene terephthalate) and the preferred surface roughening agent is kaolinite. Other agents include calcium terephthalate, potassium acetate, potassium terephthalate and potassium 3,5-di(carbomethoxy)benzenesulfonate.

The present invention is directed to luxury type polyester filament and yarns having silk-like aesthetics. I have found that the lustrous nature of silk can be essentially duplicated by the incorporation into fiber forming poly (1,4-cyclohexylenedimethylene terephthalate) about 2 to 15% by weight of a second fiber forming polyester other than poly(1,4-cyclohexylenedimethylene terephthalate). The second polyester in spun and drafted fibers will exist as microfibrils in the poly(1,4-cyclohexylenedimethylene terephthalate). The second polyester preferably is poly(ethylene terephthalate) or poly(1,4-tetramethylene terephthalate) but may be other fiber forming polyesters suitable for forming the microfibrils such as copolyesters and the like.

The fibers of this invention are formed with non-round cross-sections such as trilobal, trilateral, delta or other variants of generally triangular cross-sections. Also, I prefer to use about 200 ppm of an optical brightener in the polymer. For example, that disclosed in U.S. Pat. No. 3,260,715 may be used.

The luxurious hand or handle of silk fabrics can be obtained by the use of differentially shrinking filaments. Theretofore it has been thought that in order to obtain differential shrinkage in the silk-like yarn that the filaments must be produced by a process in which two processing lines are used and the filaments combined prior to use as disclosed in U.S. Pat. 3,705,225. In this invention I have unexpectedly obtained differentially shrinking filaments from a single processing line in the novel combination of poly(1,4-cyclohexylenedimethylene terephthalate) and the polyesters described in this specification.

This invention will be further illustrated by the following examples although it will be understood that these examples are included merely for purposes of illustration and are not intended to limit the scope of the invention.

EXAMPLE 1

A poly(1,4-cyclohexylenedimethylene terephthalate) type trilateral filament yarn is spun from a blend of poly(1,4-cyclohexylenedimethylene terephthalate) polymer and poly(ethylene terephthalate) polymer containing 200 ppm of an optical brightener in a ratio of 10:1 and ground to pass through a 20 mesh screen. Spinning is carried out in the usual manner in which poly(1.4-cyclohexylenedimethylene terephthalate) fibers are spun, using a sand pack. Yarn is taken up at ~1000 m/min. Drafting is carried out in the usual manner using a draft ratio of ~3:1. An antistatic lubricant is applied to the fiber during spinning. The fiber so produced had a structure in which microfibrils of poly(ethylene terephthalate), about 50-150A in cross section and 500-1000A in length were imbedded, randomly distributed, throughout a matrix of poly(1,4-cyclohexylenedimethylene terephthalate). These fibers had the following typical properties:

Tenacity; 3.1 g/den.
Elongation; 25%
Modulus; 27 g/den.
Boiling water shrinkage; 3.5%
Air shrinkages at 175° C.; 10.5%
Liveliness index; 0.222[1]
Work recovery at 5%; 50%
I.V.; 0.63[2]

The fiber exhibited differential shrinkage of filaments at 175° C. from 4.5% to 12% with two populations, one peaking at 6%, the other at 8.5%. Goniophotometric curves of luster were very similar to those obtained for degummed and bleached silk fibers.

[1]Liveliness index is a measure of the liveliness of the fiber--the more lively the fiber the higher the index. Liveliness index is determined by stretching the fiber 5 percent at a rate of 10 percent of the initial fiber length per minute and then allowing the fiber to return at the same rate while the stress strain curve is plotted on an automatic recorder. The liveliness index is the ratio of the square root of the elastic modulus ($E_i$) to secant recovery modulus ($E_r$):

$$\text{Liveliness Index} = \sqrt{E_i/E_r}$$

[2]Inherent viscosity is determined at 25° C. in 60/40 phenol/tetrachloroethane at a concentration of 0.5 g./100 ml.

EXAMPLE 2

A poly(1,4-cyclohexylenedimethylene terephthalate) type trilateral filament yarn is spun from a blend of poly(1,4-cyclohexylenedimethylene terephthalate) polymer and poly(ethylene terephthalate) polymer containing 200 ppm of an optical brightener in a ratio of 95:5 ground to pass through a 20 mesh screen. Spinning is carried out in the usual manner in which poly(1,4-cyclohexylenedimethylene terephthalate) fibers are spun, using a head temperature of 295° C. and a sand pack filter. Yarn is taken up at ~700 m/min. Drafting is carried out in the usual manner using a draft ratio of 3.5:1. An antistatic lubricant is applied to the fiber during spinning. The fiber so produced had a structure in which microfibrils of poly(ethylene terephthalate) about 50-150A in cross-section and 500-1000A in length were imbedded, randomly distributed, throughout a matrix of poly(1,4-cyclohexylenedimethylene terephthalate). These fibers had the following typical properties:

Tenacity; 3.1 g/den.
Elongation; 25%
Modulus; 25 g/den.

Boiling water shrinkage; 3.5%
Air shrinkage at 175° C.; 12%
Liveliness index; 0.250
Work recovery at 5%; 55%
I.V.; 0.65

The fiber exhibited differential shrinkage of filaments at 175° C. from 4.5% to 15%, with two populations, one peaking at 6%, the other at 8.5%. Goniophotometric curves of luster were very similar to those obtained for degummed and bleached silk fibers.

EXAMPLE 3

A 65/43 trilateral filament yarn is spun from a copolyester of terephthalic acid (90%) and isophthalic acid (10%) and polycyclohexanedimethanol containing 10% by weight of poly(ethylene terephthalate) and 200 ppm of an optical brightener under conditions described in Example 1. Similar results were obtained to those of the fibers spun under Example 1.

EXAMPLE 4

A 65/43 trilateral filament yarn is spun from the copolyester of Example 3 under conditions described in Example 2. Similar results were obtained to those of fibers spun under Example 2.

EXAMPLE 5

A 65/43 trilateral filament yarn is spun from a copolyester of poly(1,4-cyclohexylenedimethylene terephthalate) with (copolyester of 10% isophthalic acid and 2% 3,3'[(sodioimino)disulfonyl] dibenzoic acid) containing 10% by weight of poly(ethylene terephthalate) and 200 ppm of an optical brightener under conditions described in Example 1. Similar results were obtained to those of fibers spun under Example 1.

EXAMPLE 6

A 65/43 trilateral cross-section filament yarn is spun from the copolyester of Example 5 under conditions described in Example 2. Similar results were obtained to those of fibers spun under Example 2.

The invention has been described in detail with particular reference to preferred embodiments thereof, but it will be understood that variations and modifications can be effected within the spirit and scope of the invention.

I claim:

1. Textile fiber comprising poly(1,4-cyclohexylenedimethylene terephthalate) containing about 2 to 15 percent by weight of a second fiber forming polyester selected from poly(ethylene terephthalate), poly(tetramethylene terephthalate) or copolyester thereof, present as microfibrils, the microfibrils having diameters of 50-150A in cross section and 500-1000A in length, in the poly(1,4-cyclohexylenedimethylene terephthalate), said fiber having a luster similar to degummed and bleached silk fibers as determined by Goniophotometric luster curves, and said fiber has a non-round cross section.

2. Textile fiber of claim 1 wherein said cross section is generally triangular.

3. Textile yarn comprising fibers of poly(1,4-cyclohexylenedimethylene terephthalate) fiber containing about 2 to 15% by weight of a second polyester selected from poly(ethylene terephthalate), poly(tetramethylene terephthalate) and copolyesters thereof, the second polyester being present as microfibrils having diameters of 50-150A in cross section and 500 -10-00A in length, said fiber having a luster similar to degummed and bleached silk fibers as determined by Goniophotometric luster curves and said fiber has a non-round cross section.

4. Textile yarn of claim 3 wherein individual fibers thereof exhibit differential shrinkage.

* * * * *